US007935427B2

(12) United States Patent
Matsumoto et al.

(10) Patent No.: US 7,935,427 B2
(45) Date of Patent: May 3, 2011

(54) MAGNESIUM ALLOY PART AND PRODUCTION METHOD THEREOF

(75) Inventors: Yasuhiko Matsumoto, Shizuoka (JP); Yasushi Kishi, Shizuoka (JP); Junichi Inami, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 682 days.

(21) Appl. No.: 11/941,174

(22) Filed: Nov. 16, 2007

(65) Prior Publication Data

US 2008/0248325 A1 Oct. 9, 2008

(30) Foreign Application Priority Data

Nov. 16, 2006 (JP) ..... 2006-310260

(51) Int. Cl.
*B32B 9/00* (2006.01)

(52) U.S. Cl. ..... 428/457; 428/469; 428/696

(58) Field of Classification Search ..... None
See application file for complete search history.

(56) References Cited

U.S. PATENT DOCUMENTS

| | | | |
|---|---|---|---|
| 2,288,995 | A | 7/1942 | De Long |
| 5,683,522 | A | 11/1997 | Joesten |
| 2004/0217330 | A1 | 11/2004 | Ardelean et al. |

FOREIGN PATENT DOCUMENTS

| | | | |
|---|---|---|---|
| EP | 1 338 678 | A2 | 8/2003 |
| JP | 2001-172772 | A | 6/2001 |
| JP | 2005-146329 | A | 6/2005 |
| WO | 02/097164 | A2 | 12/2002 |
| WO | 03/002773 | A2 | 1/2003 |
| WO | 03/002773 | A3 | 1/2003 |
| WO | 2006/108655 | A1 | 10/2006 |

OTHER PUBLICATIONS

Official Communication issued in corresponding European Patent Application No. 07022146.0, mailed on Aug. 19, 2010.

*Primary Examiner* — Timothy M Speer
(74) *Attorney, Agent, or Firm* — Keating & Bennett, LLP

(57) ABSTRACT

A magnesium alloy part includes a part body composed of a magnesium alloy containing aluminum; a paint film at least partially covering the part body; and a magnesium fluoride layer provided immediately under the paint film. The magnesium alloy has an aluminum content of about 6.5 weight % or less.

7 Claims, 7 Drawing Sheets

PART BODY IS PROVIDED

BLAST TREATMENT

ALKALINE DEGREASING

ETCHING

TREATMENT WITH AQUEOUS SOLUTION OF FLUORIDE

PAINT FILM IS FORMED

FURTHER PAINT FILM IS FORMED

MAGNESIUM ALLOY PART AND PRODUCTION METHOD THEREOF

BACKGROUND OF THE INVENTION

1. Field of the Invention

The present invention relates to magnesium alloy parts, and in particular to magnesium alloy parts having a paint film. The present invention also relates to a production method for such magnesium alloy parts.

2. Description of the Related Art

Conventionally, steels (i.e., iron alloys containing carbon) have frequently been used as component parts of transportation apparatuses because they excel in mechanical properties and ease of manufacturing while being inexpensive. However, the light-weight property of transportation apparatuses has been an issue in improving the mileage (fuel consumption) and running properties thereof, and use of materials that are lighter than iron has been under study.

In recent years, inexpensive refining methods for titanium, aluminum, magnesium, etc., which have smaller specific gravities than that of iron, and production methods for alloys containing such metals, have been developed. Moreover, techniques for improving the mechanical strength and ease of manufacturing of these metals and their alloys have also been developed.

Therefore, use of titanium, aluminum, or magnesium as a material of component parts of transportation apparatuses has been proposed. In particular, magnesium has a density which is about 23% of that of iron. Therefore, the weight of a transportation apparatus can be greatly reduced by using magnesium or a magnesium alloy.

In many cases, a paint film for protective or decorative purposes is provided on the surface of a magnesium alloy part. Electrostatic painting, electropainting, and the like are known methods for forming a paint film on the surface of a magnesium alloy. In particular, electropainting is able to uniformly form a paint film, and therefore is suitably used for parts with complex outer shapes.

Methods for forming a painting underlayer on a magnesium alloy are proposed in Japanese Laid-Open Patent Publication Nos. 2005-146329 and 2001-172772.

Japanese Laid-Open Patent Publication No. 2005-146329 discloses a technique of consecutively subjecting the surface of a magnesium alloy to an etching treatment with an organic acid and then a treatment with an aqueous solution of fluoride, followed by a conversion coating treatment with an aqueous solution of phosphate, thus reducing the electrical resistance and improving the painting anti-corrosiveness and paintability of the conversion coating.

Moreover, Japanese Laid-Open Patent Publication No. 2001-172772 discloses a technique of immersing a magnesium alloy in a treatment liquid containing a fluorochemical, to which a surface tension reducer is added, thus forming a conversion coating having an excellent anti-corrosiveness and smoothness on the surface of the magnesium alloy.

By using a conversion coating which is formed by either of the techniques of Japanese Laid-Open Patent Publication Nos. 2005-146329 and 2001-172772 as a painting underlayer, the durability of a paint film can be improved.

However, since transportation apparatuses are to be used mainly outdoor, their component parts are often subjected to harsh environments. This fact has led to the desire for a further improved adhesion (i.e., a stronger reluctance to peel) of a paint film. The inventors have conducted a humidity test for magnesium alloy parts each having a painting on a conversion coating which had been formed by either technique of Japanese Laid-Open Patent Publication Nos. 2005-146329 and 2001-172772. As a result, although good results were obtained under test conditions which are generally considered as "harsh", peeling of the paint film was observed under harsher test conditions.

SUMMARY OF THE INVENTION

In order to overcome the problems described above, preferred embodiments of the present invention improve the adhesion of a paint film which is formed on the surface of a magnesium alloy part.

A magnesium alloy part according to a preferred embodiment of the present invention preferably includes a part body composed of a magnesium alloy containing aluminum; a paint film at least partially covering the part body; and a magnesium fluoride layer provided immediately under the paint film, wherein the magnesium alloy has an aluminum content of about 6.5 weight % or less.

In a preferred embodiment, the magnesium alloy has an aluminum content of about 4.4 weight % or more.

In a preferred embodiment, the paint film is formed by electropainting.

In a preferred embodiment, an aluminum content in a region down to a depth of approximately 30 μm from a surface of the part body is about 5.0 weight % or less.

In a preferred embodiment, the magnesium fluoride layer has a surface roughness of no less than about 1.6 $Rz_{JIS}$ and no more than about 50 $Rz_{JIS}$.

In a preferred embodiment, the magnesium fluoride layer is formed on a surface of the part body by a conversion treatment.

A transportation apparatus according to another preferred embodiment of the present invention includes a magnesium alloy part having the aforementioned construction.

A production method for a magnesium alloy part according to yet another preferred embodiment of the present invention preferably includes the steps of providing a part body which is composed of a magnesium alloy containing about 6.5 weight % or less of aluminum; forming a magnesium fluoride layer on a surface of the part body by immersing the part body in a solution containing a fluorochemical; and forming a paint film immediately above the magnesium fluoride layer.

In a preferred embodiment, the step of forming a paint film is conducted by electropainting.

In a preferred embodiment, the method further includes, before the step of forming the magnesium fluoride layer, a step of etching the surface of the part body.

The magnesium alloy part according to various preferred embodiments of the present invention includes a magnesium fluoride layer which is provided immediately under a paint film. Therefore, the paint film exhibits a high adhesion as compared to a magnesium alloy part in which a paint film is formed upon a phosphate coating. Moreover, the part body of the magnesium alloy part according to preferred embodiments of the present invention is composed of a magnesium alloy having an aluminum content of about 6.5 weight % or less. Therefore, lowering of the adhesion of the paint film due to any unstable aluminum fluoride that may be formed on the surface of the part body is prevented. Thus, according to preferred embodiments of the present invention, the paint film which is formed on the surface of the magnesium alloy part has an improved adhesion (i.e., reluctance to peel).

From the standpoint of realizing a high castability, it is preferable that the magnesium alloy has an aluminum content of about 4.4 weight % or more.

The inventive effect of improving the adhesion of a paint film becomes particularly prominent in the case where the paint film is formed by electropainting.

By ensuring that the aluminum content is about 5.0 weight % or less in the region down to a depth of approximately 30 μm from the surface of the part body, the effect of suppressing aluminum fluoride formation on the surface of the part body is enhanced, whereby adhesion of the paint film can be further improved.

From the standpoint of improving the adhesion of the paint film through an anchoring effect, it is preferable that the magnesium fluoride layer which is provided immediately under the paint film has a large surface roughness (preferably about 1.6 $Rz_{JIS}$ or more). However, if the surface roughness is too large, it will become difficult to uniformly form the paint film on the magnesium fluoride layer, thus causing a low anti-corrosiveness where the paint film is thin. Therefore, it is preferable that the magnesium fluoride layer has a surface roughness of about 50 $Rz_{JIS}$ or less. Thus, it is preferable that the magnesium fluoride layer has a surface roughness (ten point-average roughness) of no less than about 1.6 $Rz_{JIS}$ and no more than about 50 $Rz_{JIS}$.

The magnesium fluoride layer of the magnesium alloy part according to preferred embodiments of the present invention is typically formed by a conversion treatment.

The magnesium alloy part according to preferred embodiments of the present invention is excellent in terms of adhesion of the paint film, and therefore is suitably used for transportation apparatuses. Since transportation apparatuses are to be used mainly outdoor, their component parts are often subjected to harsh environments. However, by using the magnesium alloy part according to preferred embodiments of the present invention, it becomes possible to realize a lightweight transportation apparatus while preventing peeling of the paint film in harsh environments, thus improving the durability of the transportation apparatus.

In a production method for a magnesium alloy part according to preferred embodiments of the present invention, after forming a magnesium fluoride layer on the surface by immersing a part body which is composed of a magnesium alloy into a solution containing a fluorochemical, a paint film is formed immediately above the magnesium fluoride layer. As a result, the adhesion of the paint film can be enhanced as compared to a technique of forming a paint film upon a phosphate coating. Moreover, the part body to be provided is composed of a magnesium alloy containing about 6.5 weight % or less of aluminum. Therefore, lowering of the adhesion of the paint film due to any unstable aluminum fluoride that may be formed on the surface of the part body is prevented. Thus, according to the production method of preferred embodiments of the present invention, the paint film which is formed on the surface of the magnesium alloy part has an improved adhesion (i.e., reluctance to peel).

The inventive effect of improving the adhesion of a paint film becomes particularly prominent in the case where the step of forming the paint film is conducted by electropainting.

By etching the surface of the part body before the step of forming the magnesium fluoride layer, it becomes possible to effectively remove the aluminum near the surface of the part body when the part body is immersed in a solution containing a fluorochemical. Therefore, the aluminum content near the surface of the part body can be further reduced, thus resulting in an enhanced effect of suppressing aluminum fluoride formation.

According to various preferred embodiments of the present invention, the paint film which is formed on the surface of the magnesium alloy part has an improved adhesion (i.e., reluctance to peel).

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of the present invention will be described with reference to the accompanying drawings. Note that the present invention is not to be limited to the preferred embodiments described herein.

Figure 1:
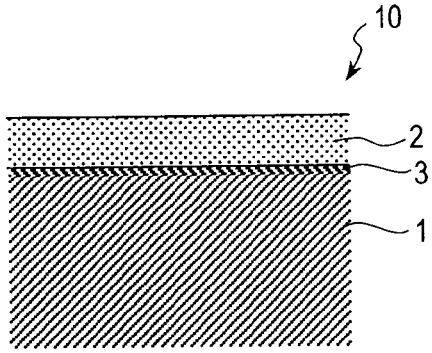
FIG. 1 is a schematic diagram showing a cross-sectional structure of a magnesium alloy part 10 according to a preferred embodiment of the present invention.

FIG. 1 shows a cross-sectional structure of a magnesium alloy part (which hereinafter may simply be referred to as a "part") 10 according to the present preferred embodiment. As shown in FIG. 1, the part 10 includes a part body 1, a paint film 2 at least partially covering the part body 1, and a magnesium fluoride layer 3 provided immediately under the paint film 2. In other words, from the surface of the part body 1, the magnesium fluoride layer 3 and the paint film 2 are stacked in this order.

The part body 1 preferably is composed of a magnesium alloy containing aluminum. The part body 1 preferably is molded into a predetermined shape by casting, for example.

The magnesium fluoride ($MgF_2$) layer 3 is preferably formed on the surface of the part body 1 by a conversion treatment. The paint film 2 is formed immediately above the magnesium fluoride layer 3.

In the case where a phosphate conversion coating is formed by a conversion coating treatment using an aqueous solution of phosphate, as in the technique disclosed in Japanese Laid-Open Patent Publication No. 2005-146329, the paint film may peel in a humidity test. This is considered because, under harshly humid conditions, the phosphate conversion coating reacts with water and becomes unstable.

In the present preferred embodiment, the magnesium fluoride layer 3 is provided immediately under the paint film 2. In other words, the paint film 2 is formed immediately above the magnesium fluoride layer 3. Since the magnesium fluoride layer 3 is more stable in a humid environment than a phosphate conversion coating, the magnesium alloy part 10 of the present preferred embodiment exhibits a strong adhesion of the paint film 2 as compared to a magnesium alloy part which is composed of a phosphate conversion coating having a paint film provided thereon.

Moreover, with respect to a paint film which is formed on a conversion coating that has been formed by the technique disclosed in Japanese Laid-Open Patent Publication No. 2001-172772, the inventors have investigated into the reason why peeling of the paint film occurs. It has been discovered that, since the technique disclosed in Japanese Laid-Open Patent Publication No. 2001-172772 uses a magnesium alloy having a large aluminum content (specifically, AZ-91A, AZ-91B, or AZ-91D) as the material of the part body, an unstable aluminum fluoride may occur on the surface of the part body during a conversion treatment, thus leading to the peeling of the paint film. AZ-91A, AZ-91B, and AZ-91D each have an aluminum content in the range of about 8.3 weight % to about 9.7 weight %.

The part body 1 according to the present preferred embodiment is composed of a magnesium alloy whose aluminum content accounts for a predetermined value or less, specifically, a magnesium alloy having an aluminum content of about 6.5 weight % or less. As a result, lowering of the adhesion of the paint film 2, which is associated with an unstable aluminum fluoride that is formed on the surface of the part body 1, is prevented.

As described above, preferred embodiments of the present invention provides an improved adhesion (i.e., reluctance to peel) of the paint film 2 which is formed on the surface of the magnesium alloy part 10.

Hereinafter, with reference to FIGS. 2A to 2D and FIGS. 3A to 3D, a production method for the part 10 will be specifically described. FIGS. 2A to 2D and FIGS. 3A to 3D are step-by-step cross-sectional views schematically showing production steps of the part 10.

Figure 2A:
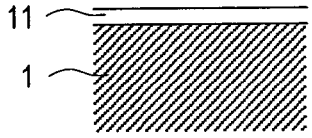
FIGS. 2A to 2D are step-by-step cross-sectional views schematically showing production steps of the magnesium alloy part 10.

First, as shown in FIG. 2A, a part body 1 is provided which is formed of a magnesium alloy containing about 6.5 weight % or less of aluminum. For example, AZ31B, AM60B, or AM50A may be used as the magnesium alloy containing about 6.5 weight % or less of aluminum. The magnesium alloys exemplified herein have compositions as shown (in weight %) in Table 1 below. The part body 1 has been molded into a predetermined shape by casting, for example. On the surface of the part body 1 fresh from casting, as shown in FIG. 2A, there are a contamination layer 11 which may have originated in a release agent that was applied on the die, etc., and some abnormal structures which may have occurred during casting. Note that, in order to maintain a high mechanical strength worthy of a structural material, it is preferable that the magnesium alloy has an aluminum content of about 2.5 weight % or more. From the standpoint of realizing a high castability, it is preferable that the magnesium alloy has an aluminum content of about 4.4 weight % or more.

TABLE 1

| | Al | Zn | Cu | Fe | Mn | Ni | Si | others | standard |
|---|---|---|---|---|---|---|---|---|---|
| AZ31B | 2.5 \| 3.5 | 0.6 \| 1.4 | 0.05 | 0 | 0.2 \| 0.5 | 0 | 0.1 | 0.3 | ASTM B107 |
| AM60B | 5.5 \| 6.5 | 0.22 | 0.01 | 0 | 0.24 \| 0.6 | 0 | 0.1 | 0.02 | JIS H5303 |
| AM50A | 4.4 \| 5.4 | 0.22 | 0.01 | 0.004 | 0.26 \| 0.6 | 0.002 | 0.1 | 0.02 | ASTM B94/94 |

TABLE 1-continued

| | Al | Zn | Cu | Fe | Mn | Ni | Si | others | standard |
|---|---|---|---|---|---|---|---|---|---|

Figure 2B:
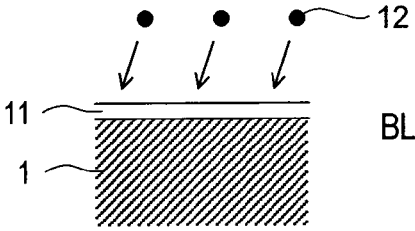
Figure 2C:
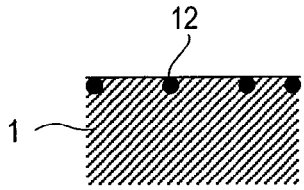

Next, as shown in FIG. 2B, the surface of the part body 1 is subjected to a blast treatment, such as shot blasting, in order to remove the contamination layer 11 and abnormal structures. This blast treatment also provides for a uniform exterior appearance of the part body 1 and removes small burrs. In the case of performing a shot blasting treatment as the blast treatment, zinc (Zn) spheres having a diameter of about 0.6 mm may be used as a shot medium 12, for example. The shooting speed and shooting density may be selected according to the size and purpose of the part 10 to be produced, the composition of the magnesium alloy, and the like. The shot medium 12 may be shot by a known method, e.g., centrifugal force, compressed air, or hydraulic technique. When a shot blasting treatment is performed, as shown in FIG. 2C, some of the shot medium 12 will be driven into the part body 1.

Figure 2D:
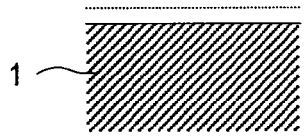

Next, as shown in FIG. 2D, a cleaning with an alkaline solution (called "alkaline degreasing") is performed in order to remove any greasy soil and shot medium 12 that is present on the surface of the part body 1. An alkaline degreasing can be performed by, for example, immersing the part body 1 for about five minutes in a strong alkaline 15% aqueous solution (GFMG15SX from MILLION CHEMICAL CO., LTD.), which serves as an alkaline solution (degreaser), while maintaining the aqueous solution at about 70° C.

Figure 3A:
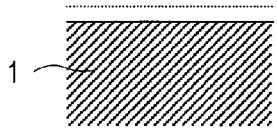
FIGS. 3A to 3D are step-by-step cross-sectional views schematically showing production steps of the magnesium alloy part 10.

Thereafter, as shown in FIG. 3A, the surface of the part body is etched. This etching is performed to remove any release agent remaining on the surface of the part body 1 and any alloy segregation layer formed on the surface of the part body 1. As the treatment liquid (etchant), a 2% aqueous solution of phosphoric acid can be used, for example. Such an etching with an aqueous solution of phosphoric acid may be performed for approximately one to five minutes, for example.

Figure 3B:
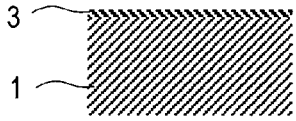

Next, as shown in FIG. 3B, the part body 1 is immersed in a solution containing a fluorochemical (aqueous solution of fluoride), thus forming a magnesium fluoride layer 3 on the surface of the part body 1. At this time, any iron and nickel (which may have always been contained in the magnesium alloy or migrated from the die) remaining on the surface of the part body 1 is melted away by the aqueous solution of fluoride. Formation of the magnesium fluoride layer 3 improves the anti-corrosiveness of the surface of the part body 1, and improves the adhesion of the paint film 2.

As the aqueous solution of fluoride, various kinds of aqueous solutions containing a fluorochemical can be used. For example, about 10% to about 30% (preferably about 20%) hydrofluoric acid (HF aqueous solution) can be used. It is also preferable to add a surface tension reducer (e.g., ethanol) to the aqueous solution of fluoride. Addition of a surface tension reducer will lower the surface tension of the aqueous solution of fluoride, thus making it easy to uniformly form the magnesium fluoride layer 3 even over the cold shuts and flow lines (which are surface defects that may be formed during casting), if any, of the part body 1. The temperature of the aqueous solution of fluoride only need to be maintained at a temperature such that the chemical reaction of the fluorochemical with the magnesium which is contained in the part body 1 occurs a moderate rate, e.g., about 10° C. to about 40° C. The immersion time is to be appropriately set depending on the desired thickness of the magnesium fluoride layer 3. In order to ensure a sufficient anti-corrosiveness, it is preferable that the magnesium fluoride layer 3 is formed to a thickness of no less than about 0.1 μm and no more than about 1 μm, and the immersion time is about one to ten minutes, for example.

Figure 3C:
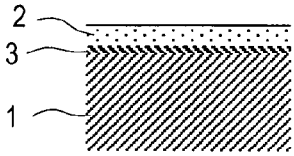
Figure 3D:
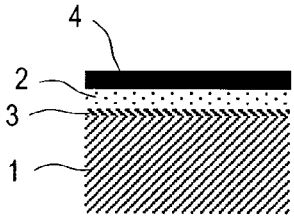

Thereafter, as shown in FIG. 3C, the paint film 2 is formed on the magnesium fluoride layer 3, whereby the magnesium alloy part 10 is completed. The paint film 2 adds a design to the exterior appearance of the part 10, and ensures anti-corrosiveness of the part 10. While electrostatic painting or electropainting may be used as a method of forming the paint film 2, the problematic peeling of the paint film of a conventional magnesium alloy part is more likely to occur in electropainting, which is a type of immersion painting, than in electrostatic painting, which is a type of spray painting. Therefore, the inventive effect of improving the adhesion of the paint film 2 becomes more prominent in the case where the paint film 2 is formed by electropainting. Note that, as necessary, a further paint film 4 may be formed by providing a top coating, as shown in FIG. 3D.

Next, results obtained by actually prototyping the magnesium alloy part 10 according to the present preferred embodiment and evaluating the adhesion of the paint film 2 in a humid environment will be described.

Table 2 below shows evaluation results of paint film adhesion with respect to the followings: Examples 1 to 3, in which the magnesium alloy had an aluminum content of about 6.5 weight % or less and a magnesium fluoride layer was formed as a primary treatment; Comparative Examples 1 to 4, in which a manganese calcium phosphate-type conversion coating was formed as a primary treatment; and Comparative Examples 5 and 6, in which a magnesium fluoride layer was formed as a primary treatment but the magnesium alloy had an aluminum content over 6.5 weight % (specifically, 9.7 weight %). Note that the adhesion evaluations of the paint film were made according to JIS K5600-7-2 (corresponding international standard: ISO6270), under the conditions of 95% humidity and 100% humidity. In Table 2, "○" indicates that no peeling of the paint film occurred, whereas "X" indicates that the paint film peeled.

On the other hand, when the aluminum content in the magnesium alloy is about 6.5 weight % or less and a magnesium fluoride layer is formed as a primary treatment, no peeling of the paint film occurred even under the 100% humidity condition (see Examples 1 to 3), and good adhesion was obtained under the 100% humidity condition even in the case where the painting method was electropainting (see Examples 1 and 2).

As described above, according to preferred embodiments of the present embodiment, the magnesium fluoride layer 3 is formed as a primary treatment, and the aluminum content of the magnesium alloy is prescribed to be about 6.5 weight % or less, whereby the paint film 2 maintains a high level of adhesion under harsh environments, irrespective of the method for forming the paint film 2. With respect to the anti-corrosiveness of magnesium alloys per se, it is known that a higher aluminum content results in a higher anti-corrosiveness. Contradictory to this conventional common technological knowledge, the present preferred embodiment purposely prescribes a smaller aluminum content (specifically, about 6.5 weight % or less) in order to enhance the adhesion of the paint film 2, as a result of which the magnesium alloy part 10 achieves an enhanced anti-corrosiveness as a whole.

Table 3 below shows evaluation results of paint film adhesion and part body castability with respect to Examples 4 to 6 and Comparative Example 7, in each of which the part body was molded by casting one of various kinds of magnesium alloys with different aluminum contents, and a magnesium fluoride layer was formed as a primary treatment. Note that, the paint film was formed by electropainting. As in Table 2, the adhesion evaluations of the paint film were made according to JIS K5600-7-2 (corresponding international standard: ISO6270), under the 100% humidity condition. Each paint film was partitioned into one hundred cells with cutting lines. Each numerical value shown in the adhesion evaluation column of Table 3 indicates the number of cells where the paint film showed peeling. With respect to castability evaluations, "○" indicates successful casting, whereas "Δ" indicates occurrence of casting defects and hence inferior moldability.

TABLE 2

| | | | primary treatment | | painting method | | paint film adhesion evaluation | |
|---|---|---|---|---|---|---|---|---|
| | alloy | Al content | MnCa phoshate type conversion coating | magnesium fluoride layer | electropainting | electrostatic painting | humidity 95% | humidity 100% |
| Ex. 1 | AZ31B | 3.5 wt % | | * | * | | ○ | ○ |
| CEx. 1 | AM60B | 6.5 wt % | * | | * | | ○ | X |
| CEx. 2 | | | * | | | * | ○ | ○ |
| Ex. 2 | | | | * | * | | ○ | ○ |
| Ex. 3 | | | | * | | * | ○ | ○ |
| CEx. 3 | AZ91D | 9.7 wt % | * | | * | | ○ | X |
| CEx. 4 | | | * | | | * | ○ | ○ |
| CEx. 5 | | | | * | * | | ○ | X |
| CEx. 6 | | | | * | | * | ○ | ○ |

Ex. = Example
CEx. = Comparative Example

As can be seen from Table 2, in all of Examples 1 to 3 and Comparative Examples 1 to 6, no peeling of the paint film occurred under the 95% humidity condition, thus indicating good adhesion. However, in Comparative Examples 1, 3 and 5 (in which electropainting was used as the painting method), some peeling of the paint film was observed under the 100% humidity condition, thus falling short of good adhesion. The presumable reason why the paint film is more likely to peel in the case of electropainting is that a portion of the conversion coating changes its nature during the electropainting step, and this changed portion undergoes a further change in the 100% humidity environment to result in a lower adhesion.

TABLE 3

| | Ex. 4 | Ex. 5 | Ex. 6 | CEx. 7 |
|---|---|---|---|---|
| Mg alloy | AZ31B | AM50A | AM60B | AZ91D |
| Al content | 2.5-3.5 weight % | 4.4-5.4 weight % | 5.5-6.5 weight % | 8.3-9.7 weight % |
| adhesion evaluation | 0 | 0 | 0 | 100 |

TABLE 3-continued

| | Ex. 4 | Ex. 5 | Ex. 6 | CEx. 7 |
|---|---|---|---|---|
| castability evaluation | Δ | ○ | ○ | ○ |

As can be seen from Table 3, in Comparative Example 7 having an aluminum content from 8.3 to 9.7 weight % (i.e., exceeding about 6.5 weight %), all cells showed peeling of the paint film. On the other hand, in Examples 4 to 6 having an aluminum content of about 6.5 weight % or less, none of the cells showed peeling of the paint film. However, Example 4 exhibited some casting defects when casting the part body 1, thus resulting in a lower moldability. Therefore, from the standpoint of enhancing the castability, it is preferable that the magnesium alloy has an aluminum content of about 4.4 weight % or more, as in Examples 5 and 6.

Figure 4:
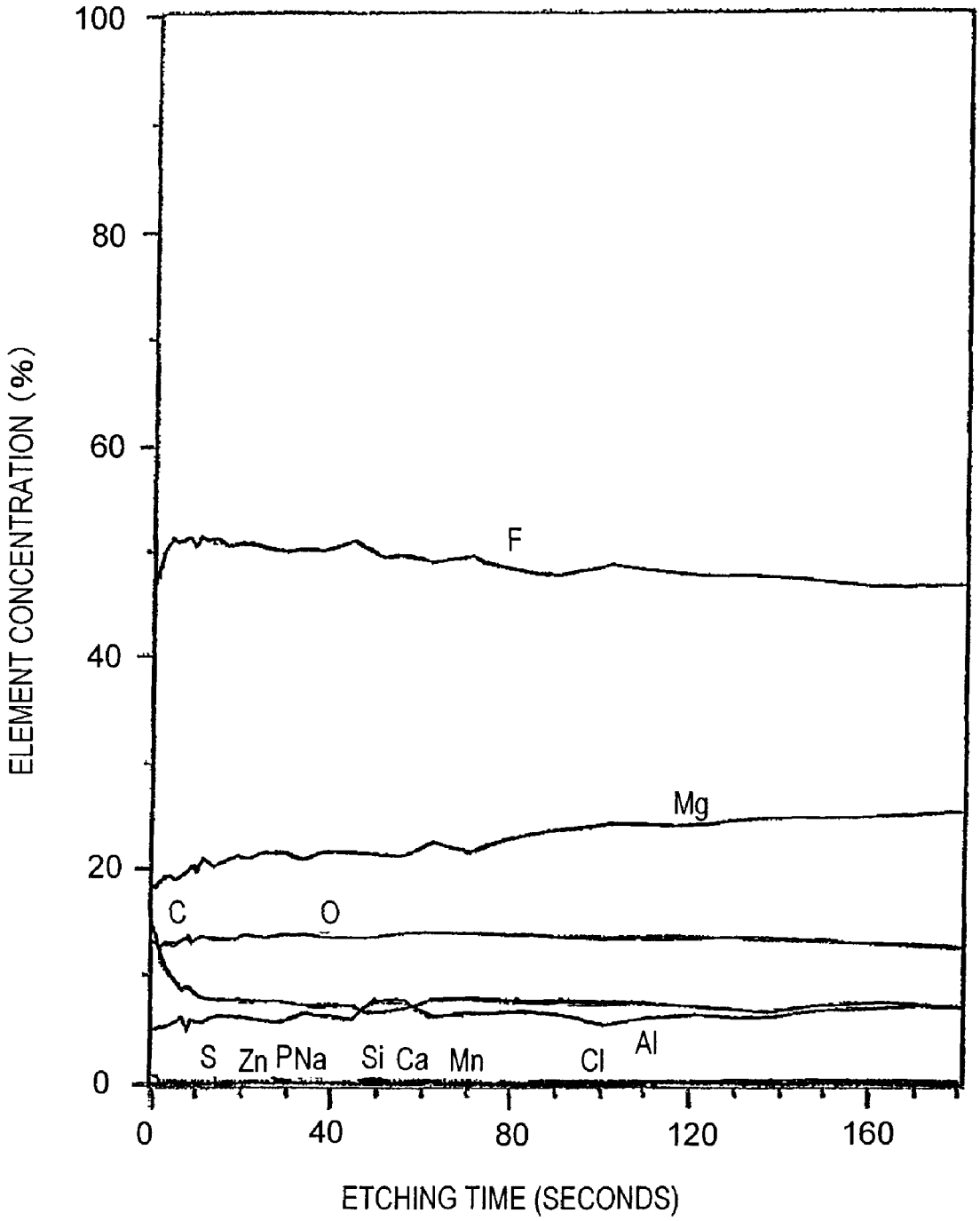
FIG. 4 is a graph showing a depth-direction element distribution after a treatment with an aqueous solution of fluoride, analyzed by ESCA.

In order to confirm that the magnesium fluoride layer 3 had been formed through a treatment using an aqueous solution of fluoride, a depth-direction profile of element concentration was measured by ESCA technique (electron spectroscopy for chemical analysis), after performing the treatment with an aqueous solution of fluoride (i.e., the step shown in FIG. 3B); the results are shown in FIG. 4. In FIG. 4, depth is shown on the horizontal axis (as converted into etching time (seconds)). It can be seen from FIG. 4 that the fluorine concentration increases at the surface of the part body 1, thus indicating the presence of the magnesium fluoride layer 3 at the surface of the part body 1.

From the standpoint of improving the adhesion of the paint film 2 through an anchoring effect, it is preferable that the magnesium fluoride layer 3, which is provided immediately under the paint film 2, has a surface roughness (ten point-average roughness) of about 1.6 $Rz_{JIS}$ or more. However, if the surface roughness is too large, it will become difficult to uniformly form the paint film 2 on the magnesium fluoride layer 3, possibly causing a low anti-corrosiveness where the paint film 2 is thin. Therefore, it is preferable that the magnesium fluoride layer 3 has a surface roughness not exceeding about 50 $Rz_{JIS}$. Thus, it is preferable that the magnesium fluoride layer has a surface roughness of no less than about 10.6 $Rz_{JIS}$ and no more than about 50 $Rz_{JIS}$.

Since the surface roughness of the magnesium fluoride layer 3 reflects the surface roughness of the part body 1, it is possible to ensure that the magnesium fluoride layer 3 has a surface roughness of no less than about 10.6 $Rz_{JIS}$ and no more than about 50 $Rz_{JIS}$ by ensuring that the surface roughness of the part body 1 is no less than about 1.6 $Rz_{JIS}$ and no more than about 50 $Rz_{JIS}$ before performing the step of forming the magnesium fluoride layer 3. For example, in the etching step shown in FIG. 3A, the concentration and temperature of the treatment liquid and the treatment time may be adjusted so that the part body 1 after etching has a surface roughness of no less than about 1.6 $Rz_{JIS}$ and no more than about 50 $Rz_{JIS}$. Moreover, a mechanical polish may be conducted on the surface of the part body 1 before the etching step.

As has already been described, by ensuring that the magnesium alloy which is the material composing the part body 1 has an aluminum content of about 6.5 weight % or less, formation of aluminum fluoride on the surface of the part body 1 can be prevented, whereby the adhesion of the paint film 2 can be improved. In order to enhance the effect of suppressing aluminum fluoride formation, it is preferable to further reduce the aluminum content near the surface of the part body 1. Specifically, by ensuring that the aluminum content is about 5.0 weight % or less in the region down to a depth of approximately 30 μm from the surface of the part body 1, the effect of suppressing aluminum fluoride formation is enhanced, whereby adhesion of the paint film 2 can be further improved.

As is done in the present preferred embodiment, performing a step of etching the surface of the part body 1 before the step of forming the magnesium fluoride layer 3 can easily reduce the aluminum content near the surface of the part body 1. Etching the surface of the part body 1 removes and reduces the magnesium near the surface of the part body 1, which in turn results in an increased aluminum content near the surface. Thus, by increasing the aluminum content near the surface before immersing the part body 1 into an aqueous solution of fluoride, the aluminum near the surface will be more effectively removed. This makes it easy to reduce the aluminum content near the surface of the part body 1.

Moreover, by using an aqueous solution of phosphoric acid as the treatment liquid (etchant), the aluminum content near the surface of the part body 1 can be reduced even more easily. Table 4 below shows the aluminum content (average value) in the region down to a depth of approximately 30 μm from the surface of the part body 1 (which surface will later become an interface between the magnesium fluoride layer 3 and the part body 1) with respect to the following examples: Example 7, in which etching was not performed before step of forming the magnesium fluoride layer 3; Example 8, in which etching was performed by using an aqueous solution of organic acid; and Example 9, in which etching was performed by using an aqueous solution of phosphoric acid. Note that, in all of Examples 7 to 9, AM60B was used as the magnesium alloy material composing the part body 1, and the aluminum content was measured by energy dispersive X-ray spectroscopy. Table 4 also shows the concentration of the treatment liquid and the treatment time.

TABLE 4

| | Ex. 7 no etching | Ex. 8 etching with aqueous solution of organic acid | Ex. 9 etching with aqueous solution of phosphoric acid |
|---|---|---|---|
| concentration of treatment liquid (weight %) | — | 1 | 2 |
| treatment time (seconds) | — | 60 | 60 |
| Al content near the surface of the part body | 6.5 | 6.0 | 5.0 |

As can be seen from a comparison between Example 7 and Examples 8 and 9, performing the etching reduces the aluminum content near the surface of the part body 1. As can be seen from a comparison between Examples 8 and 9, use of an aqueous solution of phosphoric acid as the treatment liquid permits a greater reduction in the aluminum content near the surface (e.g., to 5 weight % or less as shown in Table 4) than does an aqueous solution of organic acid.

Note that, as described above, the aluminum content near the surface of the part body 1 can be reduced by etching the surface of the part body 1 before the step of forming the magnesium fluoride layer 3. However, in order to reduce the aluminum content near the surface of the part body 1 (a region down to a depth of approximately 30 μm from the surface) to less than about 2.9 weight %, it becomes necessary to ensure that the magnesium alloy material composing the part body 1 has an aluminum content of less than about 4.4 weight %, which will result in a low castability. Therefore, from the standpoint of castability, it is preferable that the aluminum content in the region down to a depth of approximately 30 μm from the surface of the part body 1 is about 2.9 weight % or more. Moreover, in order to reduce the aluminum content near the surface of the part body 1 to less than about 1.0 weight %, it becomes necessary to ensure that the magnesium alloy material composing the part body 1 has an aluminum content of less than about 2.5 weight %, which will result in a low mechanical strength. Therefore, from the standpoint of realizing a high mechanical strength worthy of a structural material, it is preferable that the aluminum content in the region down to a depth of approximately 30 μm from the surface of the part body 1 is about 1.0 weight % or more.

Figure 5:
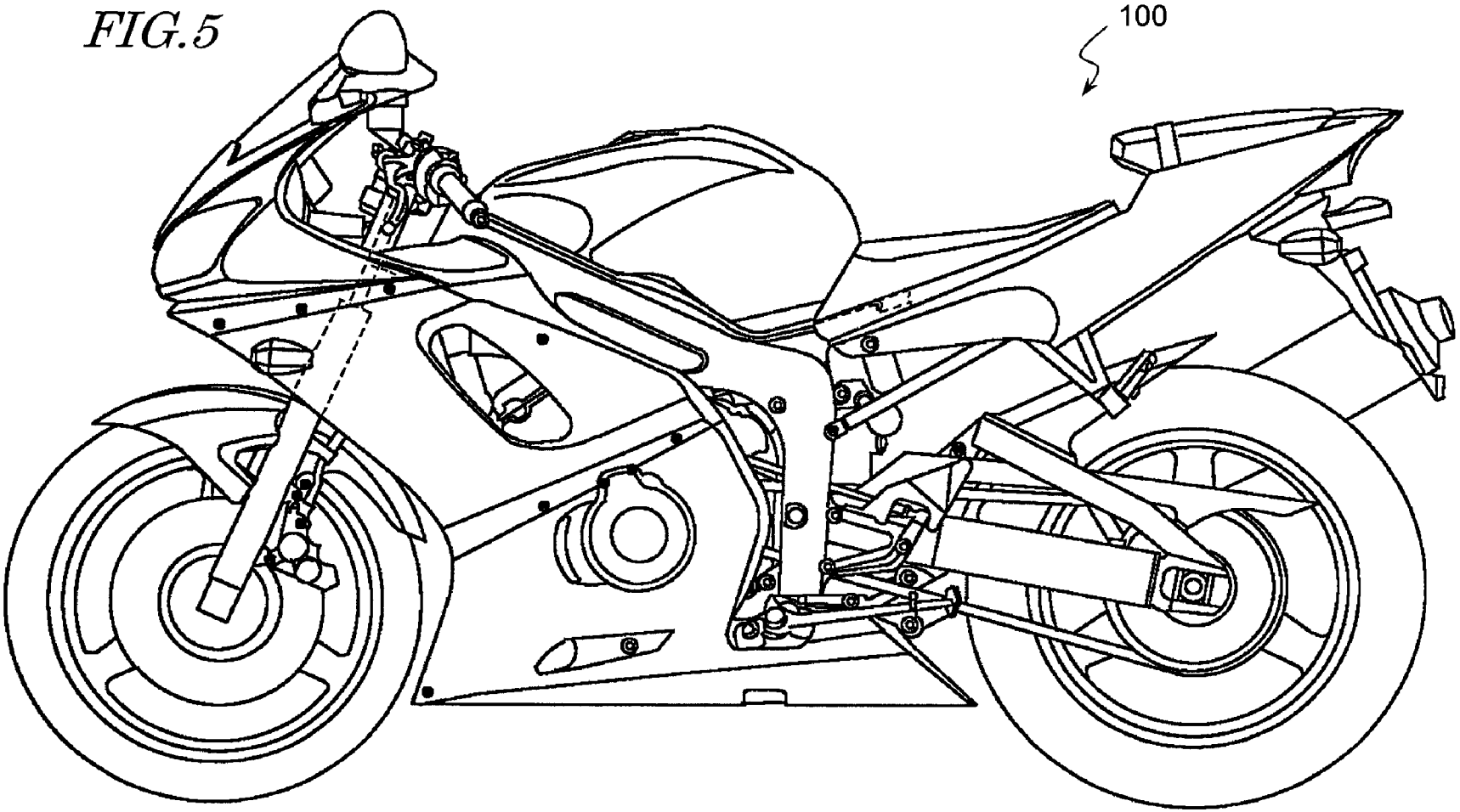
FIG. 5 is a side view schematically showing a motorcycle.

The magnesium alloy part 10 of the present preferred embodiment is excellent in terms of adhesion of the paint film 2, and therefore is suitably used for various kinds of transportation apparatuses, such as a motorcycle 100 shown in FIG. 5.

Since transportation apparatuses are to be used mainly outdoors, their component parts are often subjected to harsh environments. However, by using the magnesium alloy part 10 of the present preferred embodiment, it becomes possible to realize a light-weight transportation apparatus while suppressing peeling of the paint film 2 in harsh environments, thus improving the durability of the transportation apparatus.

Figure 6A:
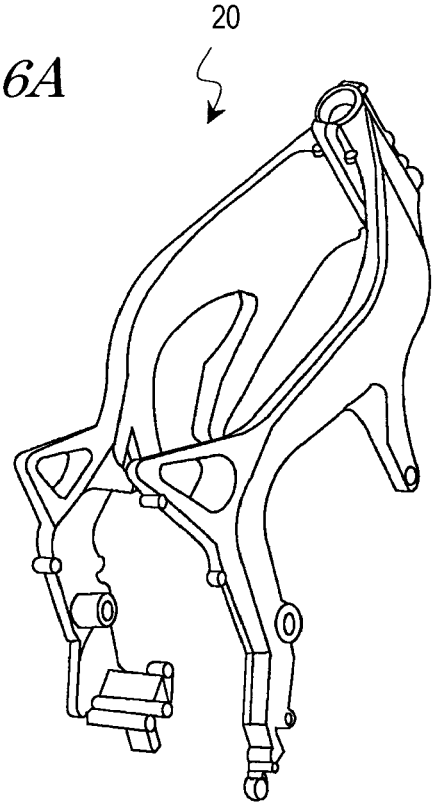
FIGS. 6A and 6B are a perspective view and a side view, respectively, schematically showing a frame of a motorcycle.
Figure 6B:
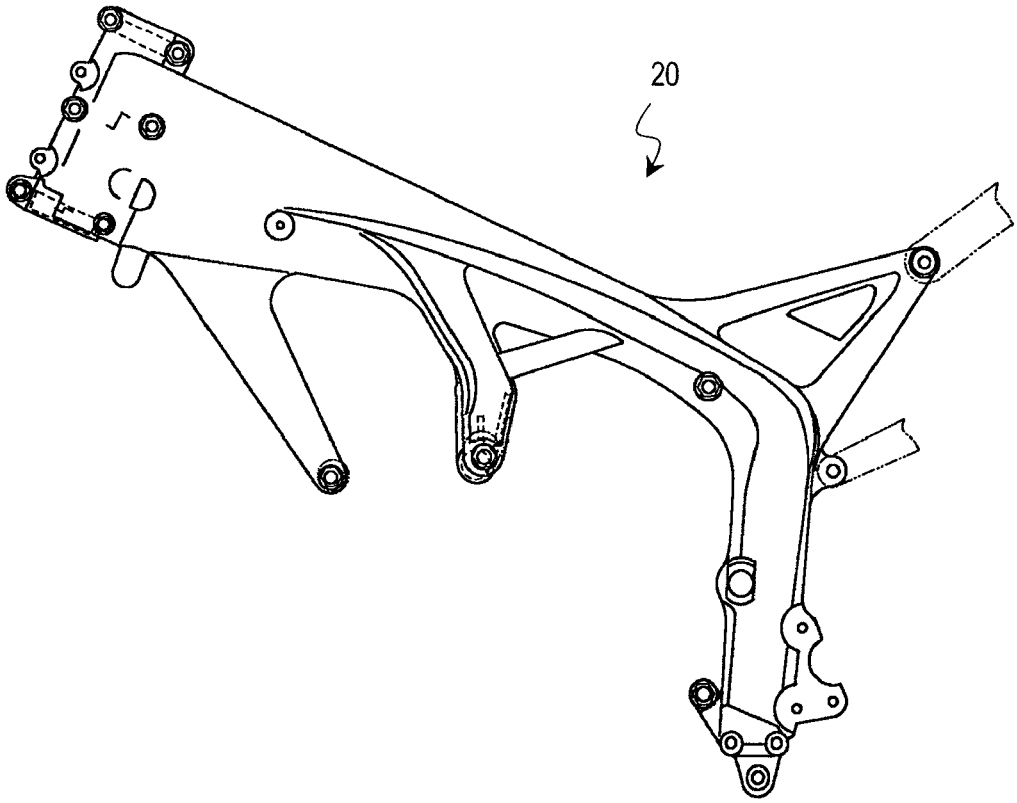
Figure 7:
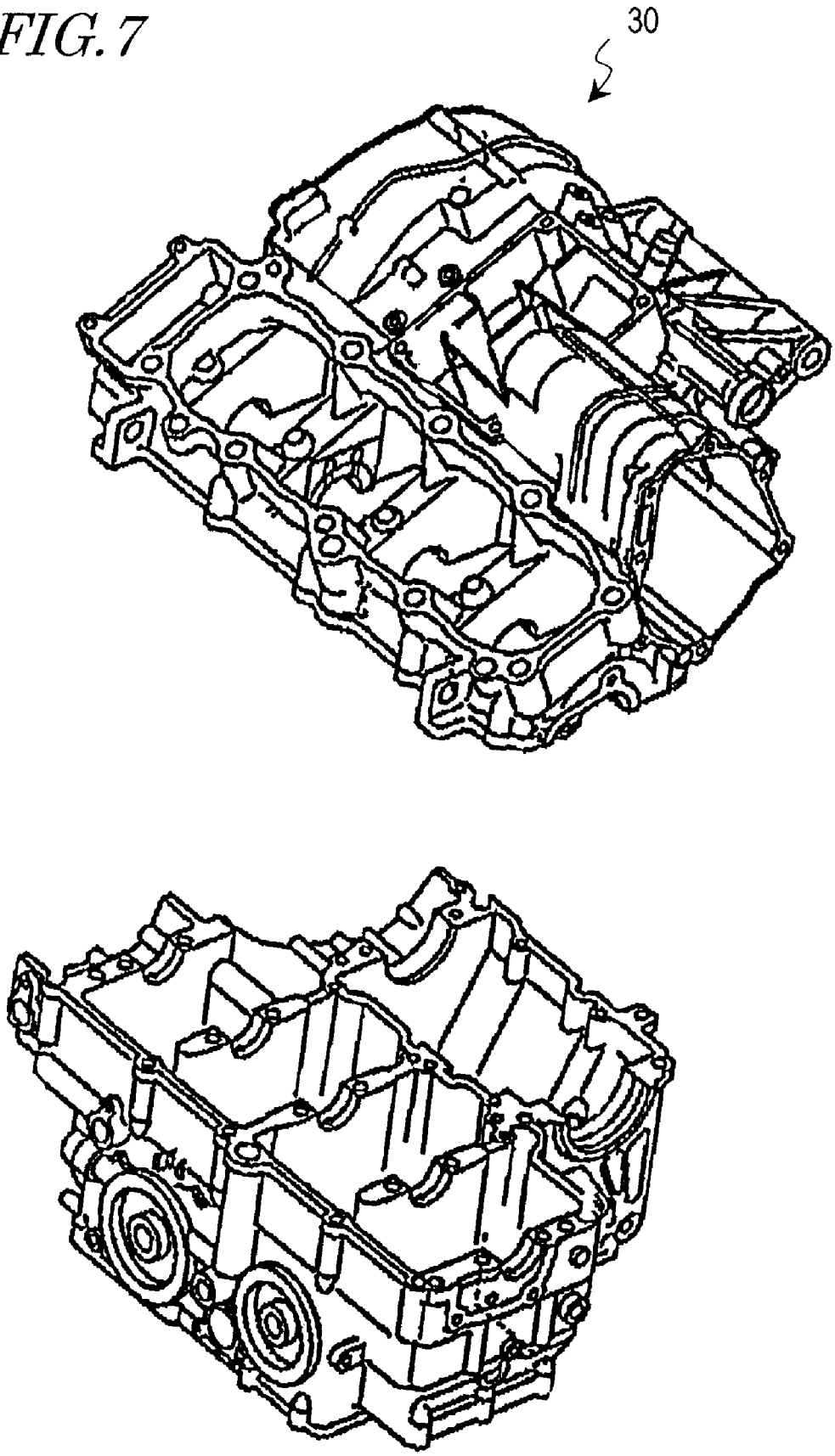
FIG. 7 is an exploded perspective view schematically showing a crankcase.
Figure 8:
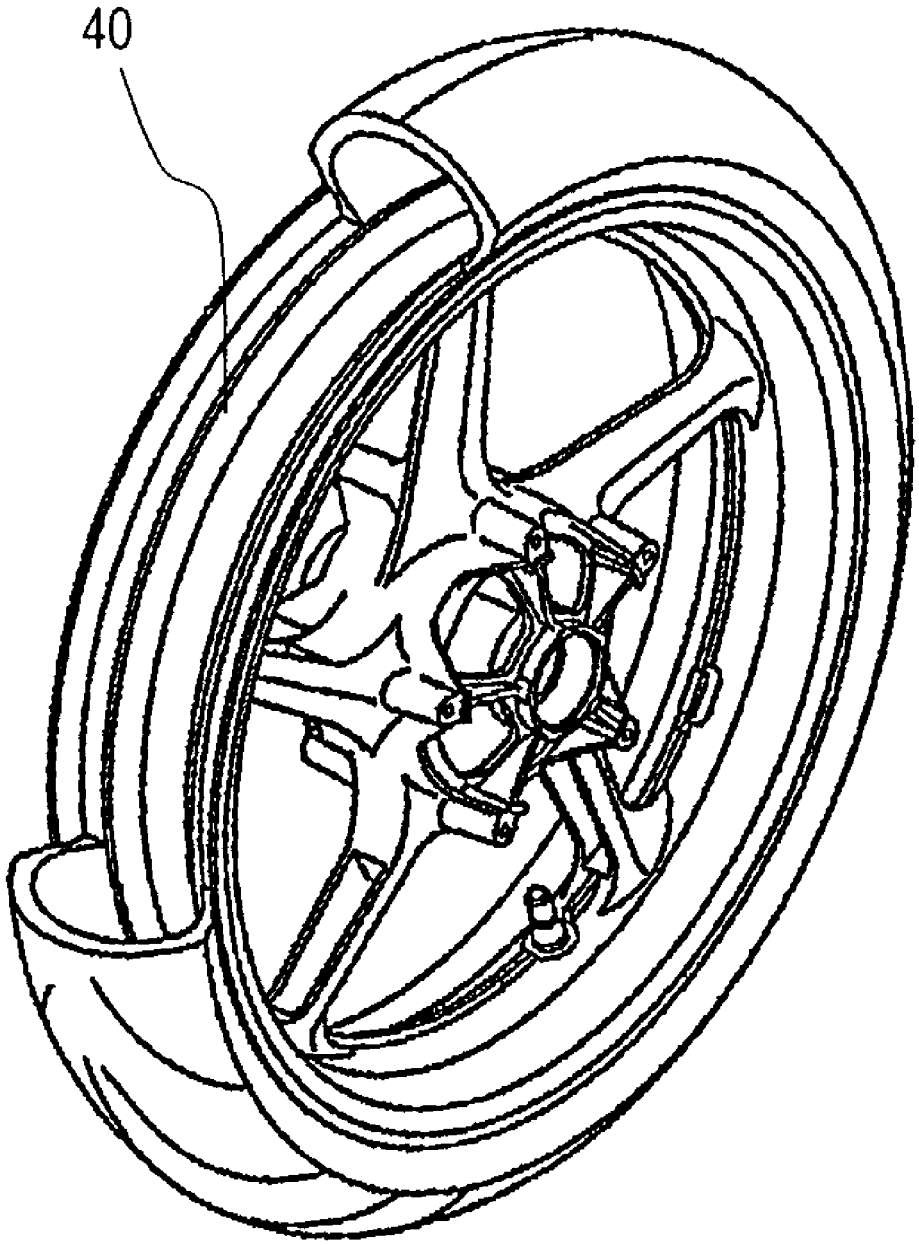
FIG. 8 is a perspective view schematically showing a wheel.

The magnesium alloy part 10 of the present preferred embodiment may be a frame 20 of a motorcycle as shown in FIGS. 6A and 6B, for example. Alternatively, the magnesium alloy part 10 of the present preferred embodiment may be a crankcase 30 as shown in FIG. 7, or a wheel 40 as shown in FIG. 8. It will be appreciated that, without being limited to those which are exemplified herein, the magnesium alloy part 10 of the present preferred embodiment can be suitably used as various parts of transportation apparatuses.

According to various preferred embodiments of the present invention, the adhesion (reluctance to peel) of a paint film which is formed on the surface of a magnesium alloy part can be improved.

The magnesium alloy part according to various preferred embodiments of the present invention can be widely used in various types of transportation apparatuses such as vehicles (e.g., motorcycles and four-wheeled automobiles), boats and airplanes.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2006-310260 filed on Nov. 16, 2006, the entire contents of which are hereby incorporated by reference. Furthermore, the entire contents of Japanese Patent Application No. 2007-291537 filed on Nov. 9, 2007, are hereby incorporated by reference.

What is claimed is:

1. A magnesium alloy part comprising:

a part body composed of a magnesium alloy containing aluminum;

a paint film at least partially covering the part body; and a magnesium fluoride layer provided immediately under and in direct contact with the paint film; wherein the magnesium alloy has an aluminum content of between about 2.5 weight % and 6.5 weight %.

2. The magnesium alloy part of claim 1, wherein the magnesium alloy has an aluminum content of between about 4.4 weight % and 6.5 weight %.

3. The magnesium alloy part of claim 1, wherein the paint film is electropainted paint film.

4. The magnesium alloy part of claim 1, wherein an aluminum content in a region down to a depth of approximately 30 μm from a surface of the part body is about 5.0 weight % or less.

5. The magnesium alloy part of claim 1, wherein the magnesium fluoride layer has a surface roughness of no less than about 1.6 $Rz_{JIS}$ and no more than about 50 $Rz_{JIS}$.

6. The magnesium alloy part of claim 1, wherein the magnesium fluoride layer is a conversion treated layer disposed on a surface of the part body.

7. A transportation apparatus comprising the magnesium alloy part of claim 1.

* * * * *